United States Patent [19]

Hinton

[11] Patent Number: 4,576,293

[45] Date of Patent: Mar. 18, 1986

[54] PRODUCE SUPPORT TRAY ASSEMBLAGE

[76] Inventor: Michael Hinton, 11121 Brenda La., La Habra, Calif. 90631

[21] Appl. No.: 578,765

[22] Filed: Feb. 9, 1984

[51] Int. Cl.[4] ..... A47F 5/00

[52] U.S. Cl. ..... 211/127; 108/102; 211/153; 211/175; 211/184

[58] Field of Search ..... 211/184, 175, 135, 153, 211/127; 108/102, 90; 312/116, 115, 126; 62/256, 251, 255

[56] References Cited

U.S. PATENT DOCUMENTS

| | | | |
|---|---|---|---|
| 958,857 | 5/1910 | Dennis | 211/127 X |
| 2,246,580 | 6/1941 | Farmer | 211/153 X |
| 2,685,372 | 8/1954 | Palaith | 211/153 |
| 3,385,452 | 5/1968 | Dantino et al. | 211/175 |
| 3,385,453 | 5/1968 | Dantino et al. | 211/175 |
| 3,760,744 | 9/1973 | Cruckshank | 108/102 X |
| 4,181,229 | 1/1980 | Moore | 211/184 |
| 4,478,337 | 10/1984 | Flum | 211/153 X |

*Primary Examiner*—Robert W. Gibson, Jr.
*Attorney, Agent, or Firm*—James E. Brunton

[57] ABSTRACT

A durable, lightweight, non-metallic replacement rack, or tray assemblage, which is uniquely designed to be readily interchangeable with the metal racks normally provided by the leading manufacturers of refrigerated cases adapted for use in displaying produce, meats, deli items and the like. The novel tray assemblage of the invention is constructed of lightweight, high density, injection molded polyethylene (structural foam). The unique assemblage embodies several interlocking, interchangeable parts such as partitions, elevated trays and data display standards, which can be interconnected so as to substantially increase the versatility of the assemblage over the metal racks of the type generally furnished by the display case manufacturers.

7 Claims, 8 Drawing Figures

PRODUCE SUPPORT TRAY ASSEMBLAGE

BACKGROUND OF THE INVENTION

1. Field of the Invention

The present invention relates generally to produce merchandising apparatus. More particularly, the invention concerns a novel non-metallic merchandising rack assemblage for use in refrigerated cases of the type found in supermarkets for displaying and merchandising meat and produce.

2. Discussion of the Prior Art

At the present time meat and produce is almost universally displayed and merchandised in supermarkets in large forwardly accessible refrigerated cases. The cases include built-in refrigeration units adapted to cause cool, moisture controlled air to flow through and about the display case. Typically, the produce is supported on wire racks mounted within the case and the cool air flows over and about the produce as it is circulated from the top and the rear of the case by a small blower associated with the refrigerated unit.

Display cases manufactured by different manufacturers are generally of somewhat different width and length. However, in almost all cases, metal wire racks are used to support the produce or meat, at a location intermediate the display case and in the path of the circulating air. These metal wire racks are generally removably supported within the case at their front and rear edges by support pins which are received within apertures formed in the front and rear walls of the case. Generally the location of these pins and the hole spacing in the walls of the cases vary from manufacturer to manufacturer so that generally replacement racks must be procured from the original manufacturer of the case.

Typically the wire racks provided by the case manufacturer comprise a plurality of transversely, or longitudinally, extending spaced apart wires which are connected proximate their extremities to rigid side or end members by soldering, brazing or the like. Racks supplied by certain of the case manufacturers tend to be somewhat flimsy and frequently break or deform during use. Additionally, because the wire racks which support the produce are continuously exposed to moisture, their useful life is very short since they tend to rust and corrode in a short time. For sanitation and appearance reasons, the rusted and corroded racks must be frequently replaced. Because of the corrosion problems, the racks provided by some manufacturers are plated or coated with a plastic coating. However, after a period of use, the coating on these racks tends to chip and flake causing them to take on a shoddy appearance. Additionally, the coating which flakes off tends to contaminate the food products housing within the display case making the racks unfit for use. If replacement racks are unavailable from the manufacturer of the case they must be custom made, often at considerable cost.

One of the primary objects of the present invention is to provide durable, lightweight, non-metallic replacement racks, or tray assemblages, which are uniquely designed to be readily interchangeable with the metal racks normally provided by the leading refrigerated case manufacturers. These novel tray assemblages are constructed of lightweight, high density, injection molded polyethylene (structural foam). The unique assemblages are extremely durable in use, can be steam cleaned, provide long life and embody several interlocking, interchangeable parts which substantially increase the versatility of the assemblages over the metal racks of the type generally furnished by the manufacturers. For example, in addition to providing the basic produce supporting rack, the assemblages of the present invention include readily interconnectible product dividers, product retainers, data display devices and deck pieces which in combination create a complete system for a superior merchandising display. Such accessories are not readily available or usable with the wire racks provided by present manufacturers.

Further, the basic produce supporting trays of the present invention are provided with uniquely designed central portions which are apertured to control and enhance the flow pattern of the refrigerated air about the produce. The previously mentioned accessory components of the assemblage are provided with cylindrically shaped interlocking portions which are adapted to removably snap into place with in the apertures provided in the supporting tray so as to permit the components of the assemblage to be quickly assembled together to meet particular merchandising requirements. Whereas, the standard wire type racks provided by the display case manufacturers tend to damage certain soft products such as fruits, cheese and the like, the unique design of the racks of the present invention inflict no such damage.

SUMMARY OF THE INVENTION

An object of the present invention is to provide a novel non-metallic rack or tray assemblage for use in refrigerated meat and produce display cases which is of universal application and is readily interchangeable with the metal wire racks provided by the leading refrigerated case manufacturers.

It is another object of the invention to provide replacement rack assemblages of the aforementioned character which are extremely durable, do not chip or flake, are impervious to water volume and are easy to clean and maintain.

Another object of the invention is to provide rack assemblages of the character described which enhances and improves the circulation of the refrigerated air within the display case.

A further object of the invention is to provide replacement rack assemblages of the class described which comprise several interlocking components which enables the creation of various types of superior merchandising displays to meet a wide variety of merchansiding requirements.

Still another object of the invention is to provide replacement rack assemblages as described in the preceding paragraphs which are easy to use and are fully adjustable to permit fast installation in display cases of varying depths and configurations.

Another object of the invention is to provide replacement rack assemblages which can be constructed of readily moldable plastic materials and which are stain resistent, impervious to attack by chemicals and readily sterilizible.

Yet another object of the invention is to provide assemblages of the type described in the preceding paragraphs in which the air circulation hole patterns are spaced so as to support the produce in a manner which prevents damage thereto but yet optimize the circulation of the cool air about the produce.

Finally it is an object of the invention to provide replaceable rack assemblies which are inexpensive to produce and which can be installed and used without specialized tools or operator training.

DESCRIPTION OF THE INVENTION

Figure 1:
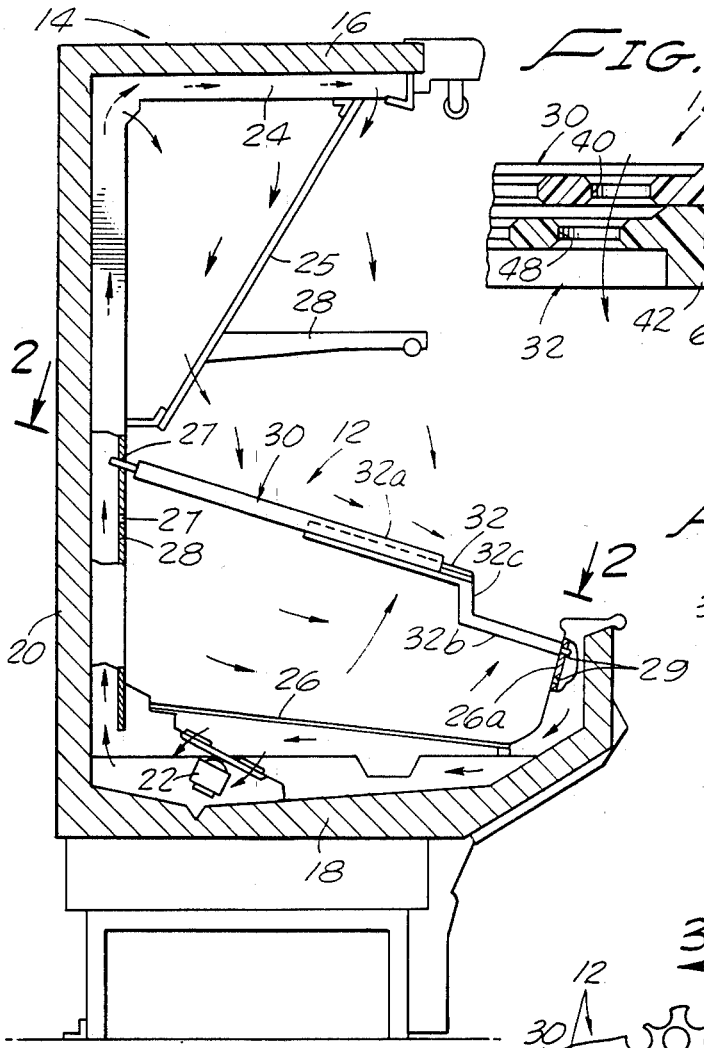
FIG. 1 is a side elevational, cross-sectional view of a refrigerated produce display case of typical construction in which one form of the non-metallic support tray assemblies of the present invention is operably affixed.
Figure 3:
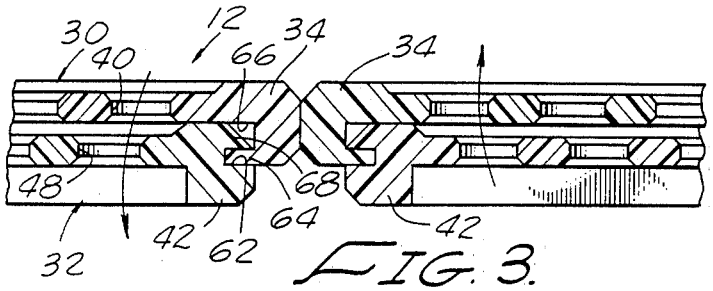
FIG. 3 is a cross-sectional view taken along lines 3—3 of FIG. 2.
Figure 2:
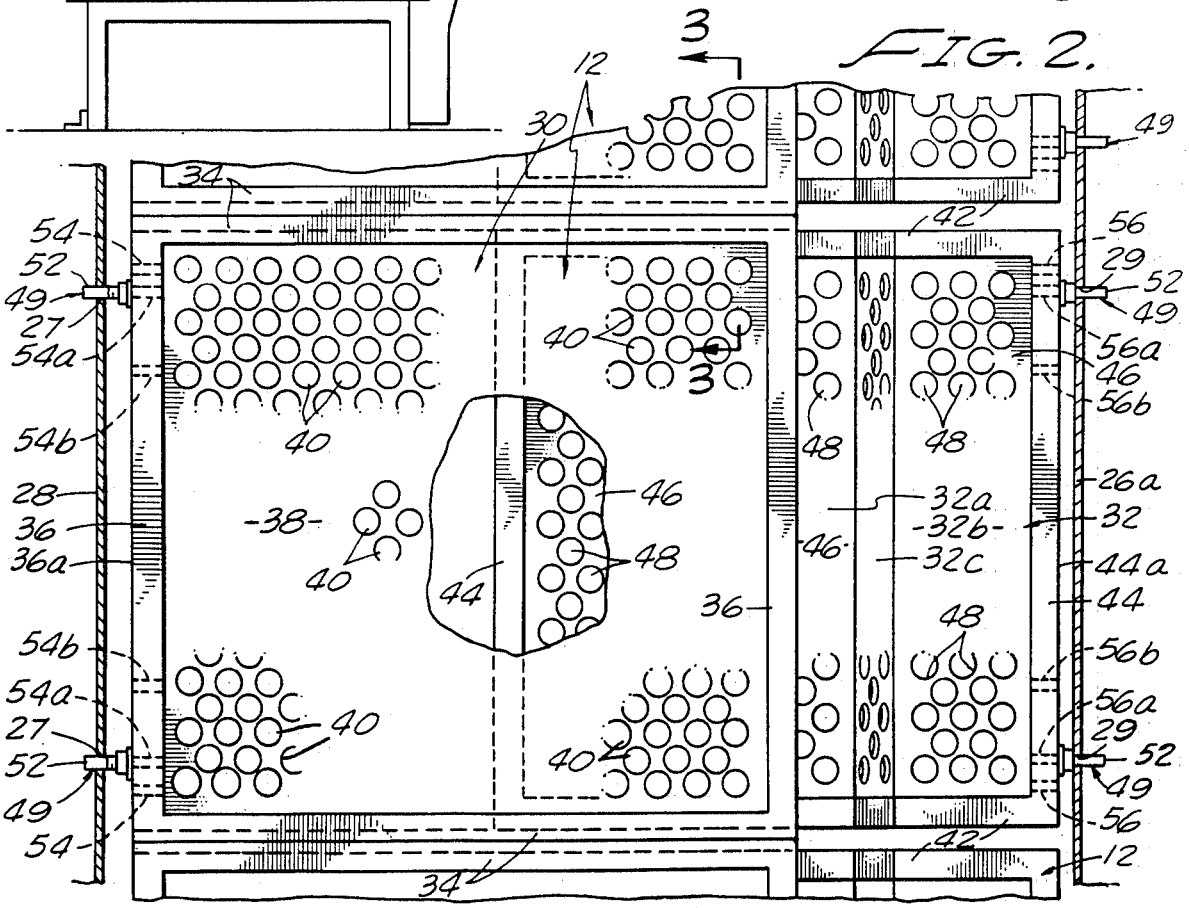
FIG. 2 is an enlarged plan view of the tray assemblies taken along lines 2—2 of FIG. 1.

Referring to the drawings and particularly to FIGS. 1, 2 and 3, non-metallic support tray assemblies of one form of the present invention are generally designated by the numeral 12. These tray assemblies are adapted to be removably positioned within a refrigerated produce display case of standard construction generally designated in FIG. 1 by the numeral 14. Display case 14 includes top, bottom and rear walls 16, 18 and 20 respectively and is open at the front for access by the supermarket customer. Operably mounted proximate the lower rear portion of the refrigerator display case 14 is a refrigeration unit including a fan assemblage 22. The design of the refrigeration unit and the fan assemblage 22 is such as to cause the circulation of cool, moist air throughout the display case in the manner generally illustrated by the arrows in FIG. 1. The purpose of this air circulation is to permit cool, moist air to continuously circulate over and about the produce, meat, deli, or other items which may be positioned on the support tray, or rack assemblies 12.

To isolate and protect the refrigeration unit and fan assemblage 22 and to produce the desired air circulation within the unit, the display case is provided with inner top, bottom and rear thin walls 24, 26 and 28 respectively. Also forming a part of this inner wall system is a forward, upwardly extending wall portion 26*a*. The inner wall system is provided with various air vents to permit air circulation in the manner illustrated by the arrows shown in FIG. 1. Additionally, the rear wall 28 and the forward wall 26*a* are provided with a plurality of spaced apertures 27 and 29 which, in a manner presently to be described, support the tray assemblies of the invention. At the upper portion of the case is an inwardly sloping wall 25 and a forwardly extending upper display rack 28. As indicated in FIG. 1, the entire refrigerated display case is mounted on a framework which is adapted to raise the case to a convenient height for front access by the produce customer.

Each of the tray assemblies of the embodiment of the invention shown in FIGS. 1 through 4 comprises first and second slidably interconnected trays 30 and 32. In FIGS. 2 and 3 multiple tray assemblies 12 are shown in a side by side configuration. However, since each of these assemblies is of identical construction, only one will be described in the paragraphs which follow. Turning particularly to FIG. 2, first tray 30 can be seen to include a pair of sides 34 and a pair of ends 36 connected to sides 34 to define a central portion 38 having a multiplicity of spaced apart first apertures 40 adapted for the passage of air therethrough along predetermined paths.

Second tray 32, also includes a pair of sides 42 and a pair of ends 44 connected to sides 42 to define a central portion 46 having a multiplicity of spaced apart second apertures 48 adapted for the passage of air therethrough along predetermined paths. As indicated in FIG. 1, the location and spacing of the apertures 40 and 48 is such that when the trays 30 and 32 are mateably interconnected the apertures will be aligned.

To removably support the tray assemblage within the display case, one end of the first tray 32, designated by the numeral 36*a* in FIG. 2, is provided with support means for engagement with the inner walls of the display case. Similarly, the second tray 32 is provided with identically constructed support means carried by the end portion thereof designated by the numeral 44*a* in FIG. 2.

Figure 4:
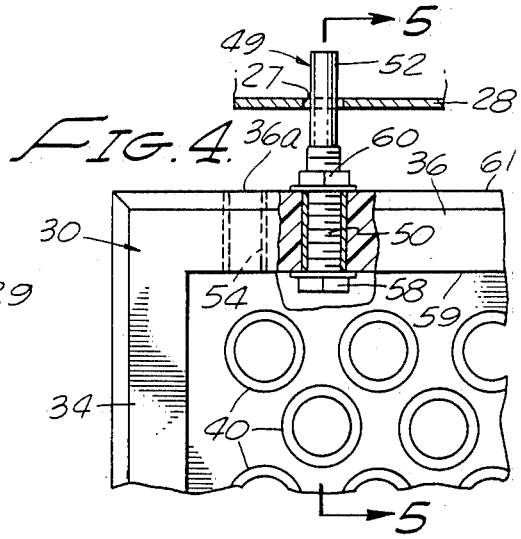
FIG. 4 is an enlarged fragmentary view, partly in section, showing the details of construction of the connector means of the invention by which the tray assemblage of the invention is removably interconnected with the display case.
Figure 5:
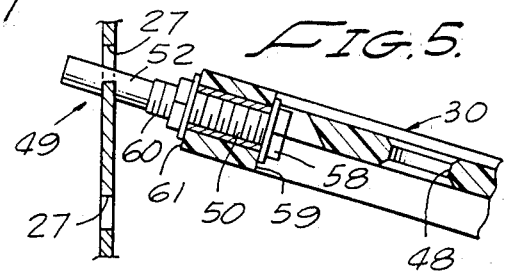
FIG. 5 is a cross-sectional view taken along lines 5—5 further illustrating the construction of the connection means of the invention.

Turning to FIGS. 4 and 5, the general configuration of the first and second support means of the invention is there illustrated. In the instant form of the invention, these support means comprise a plurality of pin assemblies 49, each of which includes an externally threaded base 50 and an outwardly extending cylindrical shank portion 52. Base portion 50 is adapted to be telescopically received within and extend through a selected one of several strategically spaced apertures 54 or 56 formed in walls 36*a* and 44*a* respectively of trays 30 and 32 (See FIG. 2). A securement member 58 is adapted to be threadably connected with base portion 50 for engagement with the inner edge (designated as 59 in FIGS. 4 and 5) of the respective end portion of the first or second tray to removably interconnect the pin assembly with the tray. A second securement member 60 is threadably receivable over base 50 for engagement with the opposite, or outer, edge 61 of the end portion of the respective tray.

As seen by referring also to FIG. 2, the cylindrical shank portion 52 of the pin assembly is adapted to be received in one of the apertures 27 or 29 formed in the inner walls of the display case. Because the location of the apertures 27 and 29 vary from case manufacturer to case manufacturer, the apertures 54 and 56 in the end walls of the trays 30 and 32 are strategically placed so that the support pin assemblies can be positioned in the proper locations to appropriately mate with the case of the particular manufacturer. For example, in the display case illustrated in the drawings, the hole spacing in the inner walls of the case is such that if the support pins are placed in the apertures designated 54*a* and 56*a* (FIG. 1) they will precisely mate with the apertures in the inner walls of the display case. If the assemblage of the invention is to be used with a display case of another manufacturer, the support pins might, for example, be removably positioned in the inner most apertures 54*b* and 56*b*. This unique feature of the invention permits the tray assemblages of the invention to be readily interchangeable with the metal wire racks provided in any one of several display cases of standard manufacture.

Turning now to FIG. 3, the tongue and groove construction of the trays 30 and 32, which permits the trays to be slidably interconnected is illustrated. For purposes of description, only one of the two tray assemblages 12 shown in FIG. 3 will be described and identified with appropriate number designations. To facilitate assembly of the trays, side portion 42 of second tray 30 is disposed below, but in a plane parallel to the plane of first tray 30. As indicated in FIG. 3, side 42 of tray 32 is provided with an elongate groove 62 extending along a portion of its length. Side portion 34 of tray 30 is provided with a tongue 64 adapted to be slidably received within groove 62. Provided intermediate tongue 64 and the upper surface of side element 34 is an elongate space, or groove, 66 adapted to slidably receive an upper portion 68 of side member 42. This construction permits quick and easy assembly of the first and second trays 30 and 32 and also enables the overall width of the assemblage to be readily adjusted to accommodate display cases of varying widths. Additionally, this adjustability between the trays permits the trays to be telescoped together so that the shank portions 52 of the support pins can be easily inserted within apertures 27 and 29 provided in the inner walls of the display case. After the pins are inserted into the apertures, the trays can then be moved apart to insure maximum penetration of the shank portions 52 into the apertures 27 and 29. It is also to be observed that, due to the length of the tongue and groove portions of trays 30 and 32, the assemblage is structurally sound and can withstand substantial downward pressures without deformation or the flexing of the assemblage.

An important feature of the tray assemblies of the invention resides in the configuration and location of the apertures 40 and 48. These apertures are specially designed to accommodate the circulation patterns of the cool, moist air which flows through the display case in a manner to optimize the flow of air over and about the produce placed on the tray assemblages.

Turning again to FIG. 1, it will be observed that in the present form of the invention, second tray 32 has spaced apart parallel upper and lower planar portions 32*a* and 32*b* which are interconnected by an angularly extending intermediate portion 32*c*. Portions 32*a* and 32*b* are contained within generally parallel planes so that a stepping effect of the tray assemblage is achieved. This type of configuration is considered advantageous for the display of certain types of products.

Figure 6:
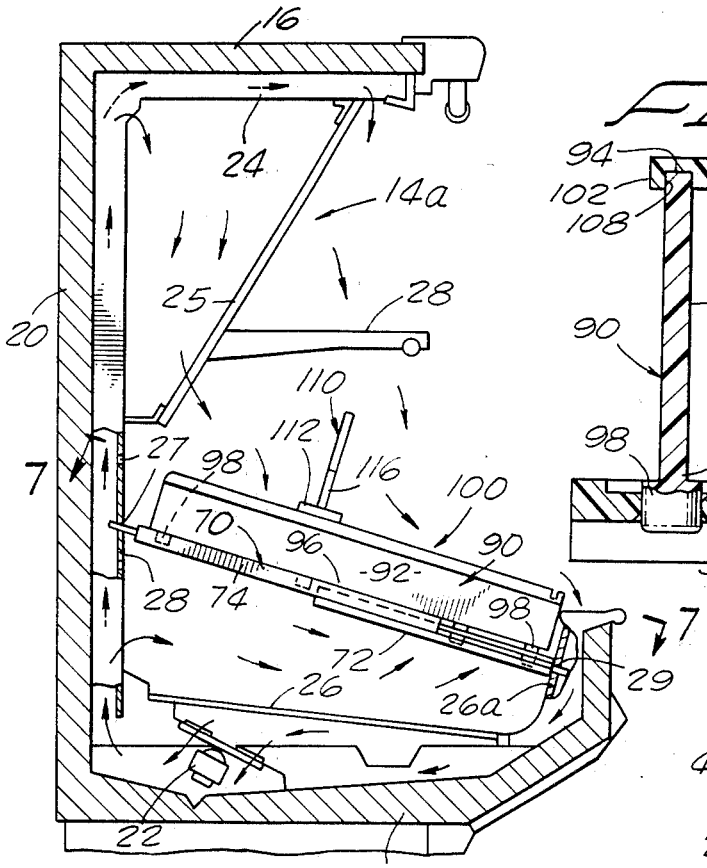
FIG. 6 is a side elevational view of a display case similar to that shown in FIG. 1, but showing removably mounted therein another embodiment of the support tray assemblies of the present invention.
Figure 8:
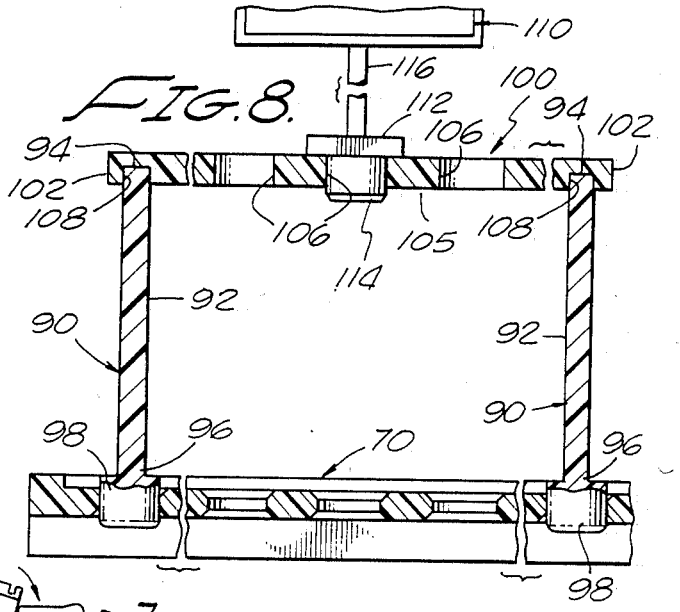
FIG. 8 is a cross-sectional view taken along lines 8—8 of FIG. 7 further illustrating the tray assemblage of a second embodiment of the invention.
Figure 7:
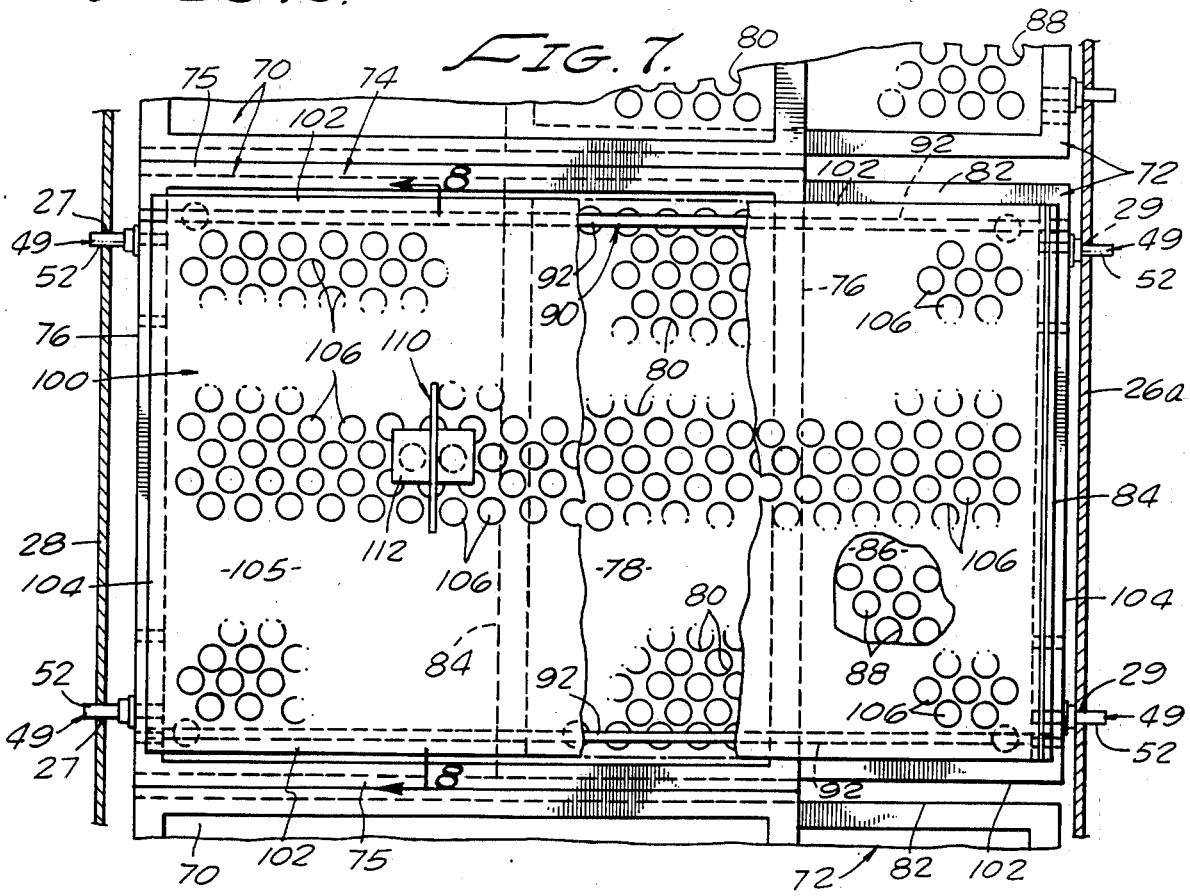
FIG. 7 is an enlarged plan view of the tray assemblies taken along lines 7—7 of FIG. 6.

Turning now to FIGS. 6, 7 and 8, non-metallic support tray assemblies of another form of the present invention are generally designated by the numeral 70. These tray assemblies are adapted to be removably positioned within a refrigerated produce display case of standard construction generally designated in FIG. 6 by the numeral 14*a*. Display case 14*a* is identical in construction to the earlier described display case 14 and like numerals are used in FIG. 6 to designate like parts.

Each of the tray assemblies 70 of the embodiment of the invention shown in FIGS. 6 through 8 comprises first and second slidably interconnected trays 72 and 74. In FIGS. 6 and 7 multiple tray assemblies 70 are shown in a side by side configuration. However, since each of these assemblies is of identical construction, only one will be described in the paragraphs which follow. Turning particularly to FIG. 7, first tray 72 can be seen to include a pair of sides 75 and a pair of ends 76 connected to sides 74 to define a central portion 78 having a multiplicity of spaced apart first apertures 80 adapted for the passage of air therethrough along predetermined paths.

Second tray 72, also includes a pair of sides 82 and a pair of ends 84 connected to sides 82 to define a central portion 86 having a multiplicity of spaced apart second apertures 88 adapted for the passage of air therethrough along predetermined paths. As indicated in FIG. 7, the location and spacing of the apertures 80 and 88 is such that when the trays 72 and 74 are mateably interconnected the apertures will be aligned.

Tray assemblages 70 are removably supported within the display case 14*a* by support means identical to those previously described. These support means are, therefore, identified by like numbers and the details of their construction are shown in FIGS. 4 and 5.

The tongue and groove portions of trays 72 and 74 are identical to those of trays 30 and 32 and FIG. 3 illustrates the details thereof.

The principal difference between assemblages 30 and 70 resides in the fact that tray 72 is planar in configuration rather than having the stepped configuration of tray 32. Otherwise the trays slidably mate in the same manner and are inserted into the display case 14*a* in the same manner.

Another difference between the embodiment of the invention shown in FIGS. 1 through 3 and that shown in FIGS. 6 through 8 resides in the provision of various accessory components now to be described.

Referring particularly to FIGS. 6 and 8, the embodiment of the invention thereshown further includes a pair of spaced apart partition or upstanding wall members 90 adapted to be removably carried by tray assemblage 70. Each partition member 90 comprises a generally planar central upstanding portion 92 having a top 94 and a base 96. Provided along base 96 are at least two spaced apart, generally cylindrically shaped protuberances 98 which depend from the base 96 in the manner shown in FIGS. 6 and 8. Protuberances 98 are formed of a diameter so as to be closely received within any of the apertures 80 and 88 of the central portions of first and second trays 72 and 74. With this construction, the partition members 90 can be snapped into position within the apertures of assemblage 70 at desired spaced apart locations. The partitions 90, when so interconnected with assemblage 70, form side or front walls useful in maintaining certain types of produce in an optimum position on the assemblage 70. In this connection, it is to be understood that the partitions 90 can be inserted either transversely or longitudinally of assemblage 70.

When the upstanding members 90 are disposed proximate either side of assemblage 70 in the manner indicated in FIG. 8, there is provided yet another component of the assemblage of the invention shown in FIGS. 6 and 8. This component comprises a third tray 100 having edge portions 102 and end portions 104 interconnected with edge portions 102 to define a central portion 105 having a multiplicity of third apertures 106 adapted for the passage of air therethrough along predetermined paths. Formed proximate edge portions 102 are elongate grooves 108 adapted to closely receive the top portions 94 of the partition members 90. With this construction, the third tray member 100 forms an elevated produce support tray which is securely supported proximate its edges by the spaced apart partitions 90, which are in turn removably affixed to tray assemblage 70. The combined or separate use of partitions 90 and third tray 100 provide another important dimension of the assemblage of this form of the invention.

Still another important aspect of the embodiment of the invention shown in FIGS. 6, 7 and 8 comprises display means for displaying data such as sales information or product identification. In the form of the invention shown in the drawings, this display means comprises a display assembly including a data display portion 110 and a base support portion 112. Base portion 112 includes at least one generally cylindrically shaped protusion 114 adapted to be closely received with any of the third apertures 106 formed in third tray member 100. So that the display portion of the device can be elevated above the level of produce or deli products supported on third tray 100, there is provided an elongated, upstanding column 116 disposed intermediate the data display portion 110 and the base 114.

Although in the drawings, the partition members 90 and the display means are shown assembled with the third tray member 100, it is to be understood that the cylindrical base portions 98 and 114 thereof are of a size to be closely received within the apertures formed in either tray assemblages 12 or 70 so that these accessories can be universally and interchangeable used with each of the tray assemblages of the invention described in the drawings. The provision of these accessories substantially increases the versatility of the apparatus of the invention over that provided by the metal wire trays, or racks, typically provided by the display case manufacturer.

As previously described, the configuration and location of the apertures formed in the trays, including third tray 100, is such as to optimize the flow of the cool moist air over and about the produce displayed within the display case 14*a*.

While various materials can be used to form the trays and the accessory components of each embodiment of the invention described herein, materials suitable for injection molding selected from the polyolefin group are preferable. A particularly satisfactory material for the purpose has been found to be polyethylene, sometimes called structural foam. This material is lightweight, durable, easily cleaned and will not corrode, chip or flake in use.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A non-metallic support tray assemblage for use in connection with refrigerated produce display cases and the like comprising:

(a) a first tray including a pair of sides and a pair of ends connected to said sides to define a central portion having a multiplicity of spaced apart first apertures adapted for the passage of air therethrough along predetermined paths, at least one of said end portions having first support means for removably supporting said end portion of said first tray within the display case; and (b) a second tray slidably interconnected with said first tray, said second tray including a pair of sides and a pair of ends connected to said sides to define a central portion having a multiplicity of spaced apart second apertures adapted for the passage of air therethrough along predetermined paths, at least a portion of said second apertures being adapted to be aligned with a portion of said first apertures in said first tray, at least one of said end portions having second support means for removably supporting said end portion of said second tray within the display case said second tray comprising first and second interconnected portions, said portions being disposed in spaced apart generally parallel planes.

2. Non-metallic support tray assemblage for use in connection with refrigerated produce display cases and the like comprising:

(a) a first tray including a pair of sides and a pair of ends connected to said sides to define a central portion having a multiplicity of spaced apart first apertures adapted for the passage of air therethrough along predetermined paths, at least one of said end portions having first support means for removably supporting said end portion of said first tray within the display case;

(b) a second tray slidably interconnected with said first tray, said second tray including a pair of sides and a pair of ends connected to said sides to define a central portion having a multiplicity of spaced apart second apertures adapted for the passage of air therethrough along predetermined paths, at least a portion of said second apertures being adapted to be aligned with a portion of said first apertures in said first tray, at least one of said end portions having second support means for removably supporting said end portion of said second tray within the display case;

(c) at least one partition member adapted to be removably carried by at least said first tray, said partition member comprising:

(i) a generally planar central portion having a top and base; and (ii) at least two spaced apart, generally cylindrically shaped protuberances depending from said base, said protuberance being of a diameter so as to be closely received within any of said apertures of said central portions of said first and second trays; and (d) a third tray including interconnected side and end portions, defining a central portion having a multiplicity of spaced apart third apertures adapted for the passage of air therethrough along predetermined paths, said side portions of said third tray having an elongate groove adapted to closely receive said top of said partition member.

3. A support tray assemblage as defined in claim 2 including display means for displaying data, comprising:

(a) a data display portion; and (b) a base portion including at least one generally cylindrically shaped protuberance depending from said base portion, said protuberance being adapted to be closely received within any of said apertures of said central portions of said first, second and third trays.

4. A support tray assemblage as defined in claim 3 in which said data display means includes an elongated upstanding column disposed intermediate said data display portion and said base portion.

5. A non-metallic support tray assemblage for use in connection with refrigerated produce display cases and the like comprising;

(a) a first tray including a pair of sides and a pair of ends connected to said sides to define a central portion having a multiplicity of spaced apart first apertures adapted for the passage of air therethrough along predetermined paths, at least one of said end portions having first support means for removably supporting said end portion of said first tray within the display case;

(b) a second tray slidably interconnected with said first tray, said second tray including a pair of sides and a pair of ends connected to said sides to define a central portion having a multiplicity of spaced apart second apertures adapted for the passage of air therethrough along predetermined paths, at least a portion of said second apertures being adapted to be aligned with a portion of said first apertures in said first tray, at least one of said end portions having second support means for removably supporting said end portion of said second tray within the display case;

(c) at least one partition member adapted to be removably carried by at least said first tray, said partition member comprising:

(i) a generally planar central portion having a top and base; and (ii) at least two spaced apart, generally cylindrically shaped protuberances depending from said base, said protuberance being of a diameter so as to be closely received within any of said apertures of said central portions of said first and second trays; and (d) a third tray including interconnected side and end portions, defining a central portion having a multiplicity of spaced apart third apertures adapted for the passage of air therethrough along predetermined paths, said side portions of said third tray having an elongate groove adapted to closely receive said top of said partition member.

6. A support tray assemblage as defined in claim 5 including display means for displaying data, comprising:

(a) a data display portion;

(b) a base portion including at least one generally cylindrically shaped protuberance depending from said base portion, said protuberance being adapted to be closely received within any of said apertures of said central portions of said first, second and third trays; and (c) an elongated upstanding column disposed intermediate said data display portion and said base portion.

7. A support tray assemblage as defined in claim 6 in which said first, second and third trays and said partition member is constructed from polyethylene.

* * * * *